United States Patent [19]

Stoops

[11] 4,104,935

[45] Aug. 8, 1978

[54] FLAT WRENCH EXTENDER TOOL

[76] Inventor: Roscoe D. Stoops, P.O. Box 537, Sneads, Fla. 32460

[21] Appl. No.: 720,757

[22] Filed: Sep. 7, 1976

[51] Int. Cl.[2] ..... B25G 1/00

[52] U.S. Cl. ..... 81/177 A; 81/90 C

[58] Field of Search ..... 81/119, 121 R, 121 B, 81/177 R, 177 A, 90 C, 71; 72/458; 140/106

[56] References Cited

U.S. PATENT DOCUMENTS

| | | | |
|---|---|---|---|
| 2,605,665 | 8/1952 | Grenat | 81/177 A X |
| 2,725,773 | 12/1955 | Anacker | 81/177 A |
| 3,039,339 | 6/1962 | Hanson | 81/DIG. 8 X |
| 3,376,768 | 4/1968 | Fortunato | 81/177 A |

FOREIGN PATENT DOCUMENTS

| | | | |
|---|---|---|---|
| 1,310,905 | 10/1962 | France | 81/177 A |
| 308,164 | 10/1918 | Fed. Rep. of Germany | 81/177 A |
| 308,164 | 10/1918 | Fed. Rep. of Germany | 81/177 A |
| 268,216 | 3/1927 | United Kingdom | 81/177 A |
| 470,487 | 12/1935 | United Kingdom | 81/177 A |

*Primary Examiner*—Al Lawrence Smith
*Assistant Examiner*—James G. Smith
*Attorney, Agent, or Firm*—Macdonald J. Wiggins

[57] ABSTRACT

A tool for temporarily coupling to a flat wrench that permits applying torque to the flat wrench in positions or locations which render the flat wrench otherwise inaccessible. In one embodiment of the invention, a flat rectangular metal bar is provided with two studs or headed posts on one side thereof and a socket drive fitting on the other side of the bar for accepting conventional socket wrench extension bars, drive handles and the like. In use, the flat wrench is placed on the nut or bolt and the tool placed over the handle of the wrench so as to permit the headed posts to engage the handle when torque is applied to the bar. A socket wrench extension bar is connected to the socket drive fitting and used in conjunction with a drive handle to produce torque on the flat wrench thereby driving the nut or bolt.

3 Claims, 8 Drawing Figures

FIG. 4
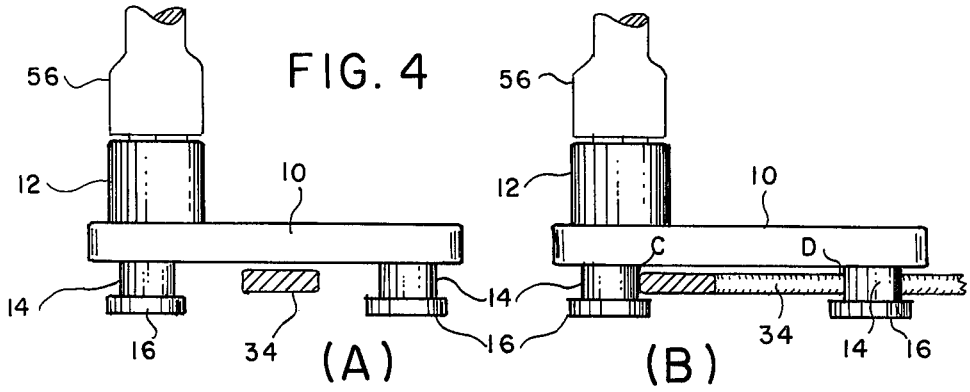
FIG. 5
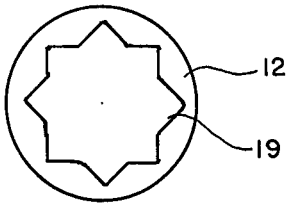
FIG. 6
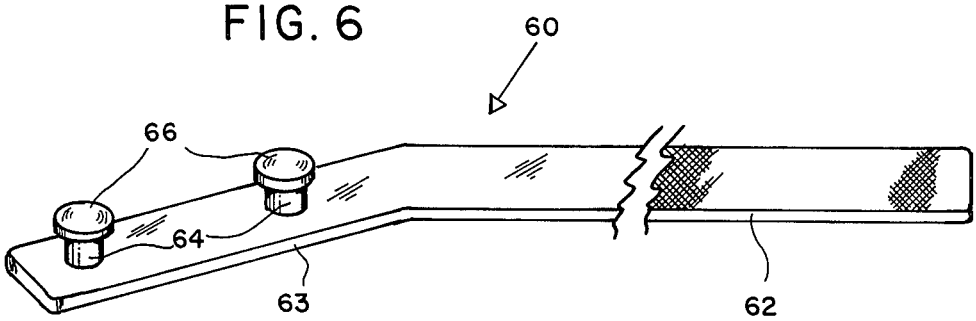
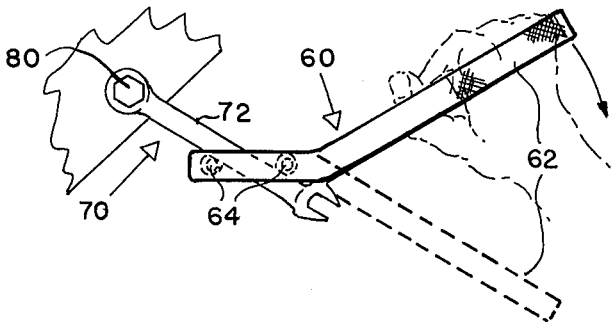
FIG. 7

FLAT WRENCH EXTENDER TOOL

BACKGROUND OF THE INVENTION

1. Field of the Invention

The present invention relates generally to an extender tool for flat, fixed-end wrenches of the box and open end type, and more specifically to an extender tool that will permit use of conventional socket wrench extension bars, drive handles, and the like to utilize such fixed-end wrenches in otherwise inaccessible locations.

2. Description of the Prior Art

Flat wrenches are available to the mechanic in a variety of sizes and designs, including fixed and adjustable open-end jaws, box ends, and jointed, universal jaws. These wrenches are usable only when there is sufficient space around the nut or bolt to be turned that the mechanic can grasp the wrench and exert the necessary turning force to its handle. However, it is often desirable to use such wrenches in very restricted locations in which there is insufficient space for socket-type wrenches, and in which the mechanic can not apply sufficient force to the wrench.

Several prior art inventions have disclosed various extension handles for flat wrenches; however most of these simply extend the length of wrench to provide additional leverage and imply sufficient space for operation. For example, Morgan, U.S. Pat. No. 1,643,027 teaches a straight extension handle with a rather complex hook arrangement to engage the handle and the unused opened jaw of a flat wrench. This device is limited to increasing leverage only and is of little use when attempting to use the flat wrench in close quarters. U.S. Pat. No. 2,490,739 to Nesbitt discloses in one embodiment an extension handle having a small offset feature which could permit use in restricted areas. However, the wrench-contacting member is large compared with the wrench size and is fabricated from sheet metal thereby limiting the strength of the device. Further, the patent teaches only an extension handle and does not speak to the problem of manipulation of the wrench in restricted areas. Thus, the known prior art pertaining to flat wrench extension devices involves increasing leverage, and does not approach the problem of using such wrenches in confined locations.

SUMMARY OF THE PRESENT INVENTION

My invention is a simple, small, rugged, and low-cost tool that couples standard socket wrench extension bars, drive handles, and the like to flat wrenches for the primary purpose of using such wrenches in an otherwise inaccessible region. The tool also can provide additional leverage to flat wrenches. A short, flat, rectangular bar is provided with a headed post attached at each end of one face, and a female square-drive socket fitting disposed on the other face. In use, the tool is placed on the handle of the flat wrench adjacent the unused jaw with the two posts straddling the handle. A square-drive socket extension bar is inserted into the female socket of the tool, and a drive handle attached to the outer end of the extension bar. Force applied to the drive handle causes the tool to rotate slightly until the posts firmly contact the edges of the flat wrench handle. Thereafter, the torque is transferred to the nut or bolt, allowing the nut or bolt to be driven even though it is in an otherwise difficult to reach position.

As may now be recognized, my flat wrench extender tool can be coupled to a flat wrench even in areas in which there is very little space in the plane of the flat wrench. The wide variety of conventional socket wrench extension bars, drive handles, and the like can be used in conjunction with my novel extender tool thereby providing the mechanic with considerable added convenience and capability when working in close quarters. The tool is quickly attached and detached from a flat wrench, yet is firmly and safely held in contact with the wrench in use. One size of my extender tool is usable with a wide range of sizes and varieties of flat-type wrenches and can be manufactured and sold at low cost.

It is therefore a principal object of my invention to provide a simple, rugged, low-cost tool for coupling a socket wrench-type drive handle to a flat wrench to permit use of the flat wrench in an otherwise inaccessible area.

It is another object of my invention to provide a flat wrench extender tool that will permit use of a socket wrench-type drive handle to increase the leverage of a flat wrench.

It is still another object of my invention to provide a flat wrench extender tool that can be used with a wide variety of socket wrench accessories tools, such as extension bars, ratchet handles, universal joints, speed handles, and the like.

It is yet another object of my invention to provide a flat wrench extender tool usable with a wide range of sizes of flat wrenches, and that can be produced in various sizes.

It is a further object of my invention to provide a flat wrench extender tool that is quickly and easily attached to and removed from a flat wrench.

It is still a further object of my invention to provide a flat-wrench extender tool usable with open-end wrenches, box wrenches, adjustable open-end wrenches, and the like.

It is still a further object of my invention to provide a flat-wrench extender tool that is small and therefore will not significantly interfere with the movement of a flat wrench.

These and other objects and advantages of my invention will become apparent from the detailed description herein below read in conjunction with the several drawings.

BRIEF DESCRIPTION OF THE DRAWINGS

FIG. 5 is an alternative design of the socket drive fitting for use with my extender tool, FIG. 6 is an alternative embodiment of my invention primarily useful to provide additional leverage to a flat wrench, and FIG. 7 is a top view of the tool of FIG. 6 in use with a flat wrench showing in dashed line a second operative position.

DETAILED DESCRIPTION OF THE PREFERRED EMBODIMENT

Figure 1:
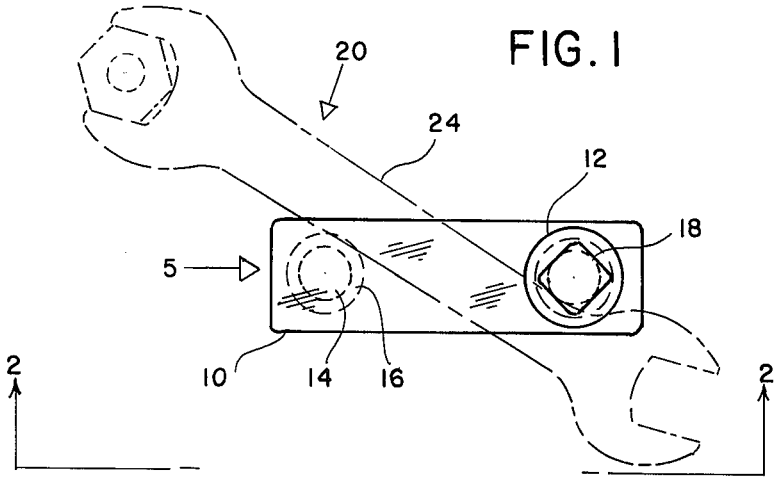
FIG. 1 is a top view of my flat-wrench extender tool shown in position on a broken-line view of a wrench to tighten a nut.
Figure 2:
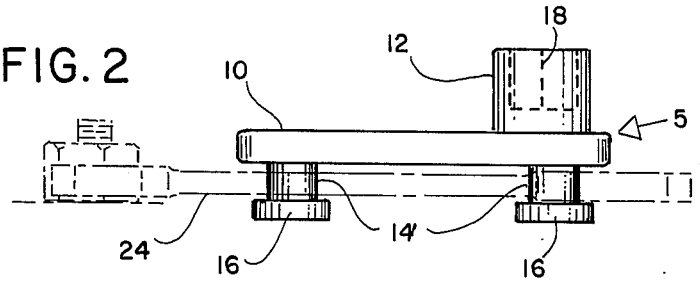
FIG. 2 is a side view of FIG. 1.

FIG. 1 and FIG. 2 show a top view and a side view of the preferred embodiment of my flat wrench extender tool 5. The tool 5 consists of a body section 10 which may be formed from a rectangular bar of steel stock; a socket drive fitting 12 welded at right angles to one face of body 10, and adjacent to one end thereof; and a pair of essentially cylindrical posts 14 projecting at right angles from the other face of body 10, with one post at each end thereof. Posts 14 have essentially enlarged concentric circular heads 16 as seen in the figures. Open-end wrench 20 shown in phantom view in FIGS. 1 and 2 is in position to tighten a nut. Posts 14 contact the edges of wrench handle 24 and heads 16 overlap handle 24 to prevent tools from slipping from the wrench when torque is applied.

Socket drive fitting 12 includes square-drive recess 18 selected to fit standard drive devices used with socket wrench sockets. As is well known, such drive sizes include one-fourth inch, three-eighth inch, and one-half inch for small and medium size sockets. The size of my tool 5 is selected as appropriate for the particular size group of flat wrenches with which it is to be used, and the size of square socket recess 18 is selected accordingly. For any size of recess 18, adapters are available to permit use of other size accessories.

An exemplary version of my extender tool useful with flat wrenches having jaw openings in the range of $\frac{1}{4}$ inch to $1\frac{1}{2}$ inch has the following dimensions:

Body 10 — $2\frac{1}{2}$ inches long by $\frac{3}{4}$ inches wide by 3/16 inches Post 14 — $\frac{3}{4}$ inches diameter by 5/16 inches high.

Head 16 — $\frac{1}{2}$ inches diameter by 3/16 inches thick.

Socket 18 — $\frac{3}{4}$ inches square.

My flat wrench extender tool 5 has the principal function of permitting a torque to be applied to a flat wrench, such as an open end wrench with fixed or adjustable jaw, a box end wrench, or a universal jaw wrench, when the wrench must be used in closely confined regions. In such instances, the user usually cannot apply sufficient force directly to the wrench handle to produce the needed torque. The manner in which my tool 5 solves this problem is illustrated in the perspective view of FIG. 3. Nut 42 is on stud 44 in a machine 40 shown in phantom view and is seen to be in such close quarters that the mechanic can not manipulate open end wrench 30 in normal fashion.

Assume for illustrative purposes that it is desired to loosen nut 42. Extender tool 5 is placed on handle 34 of wrench 30 as close as possible to unused jaw 36 with jaw 32 engaged with nut 42. A conventional socket wrench extension bar 56 of sufficient length to clear interferring portions of machine 40 is inserted into socket fitting 12. A flexhandle 50 is used to drive extension bar 56 in this example, although it is understood that, advantageously, other types of drive handles such as T-bar, ratchet and speed handles may be used. Force applied to the end of handle 50 in the direction of the arrow A, causes tool 5 to rotate slightly in direction B. This action causes posts 14 to contact the edges of flat wrench handle 34. This action is more clearly shown in FIG. 4. In FIG. 4-A, tool 5 is shown placed over flat wrench handle 34, seen in cross section, and in FIG. 4-B the effect of applying torque by means of extension bar 56 is shown. Posts 14 contact wrench handle 34 at points C and D, with heads 16 acting to hook over handle 34. As may be understood, heads 16 thus effectively prevent extender tool 5 from being disengaged from wrench handle 34 as long as the torque is maintained.

Figure 3:
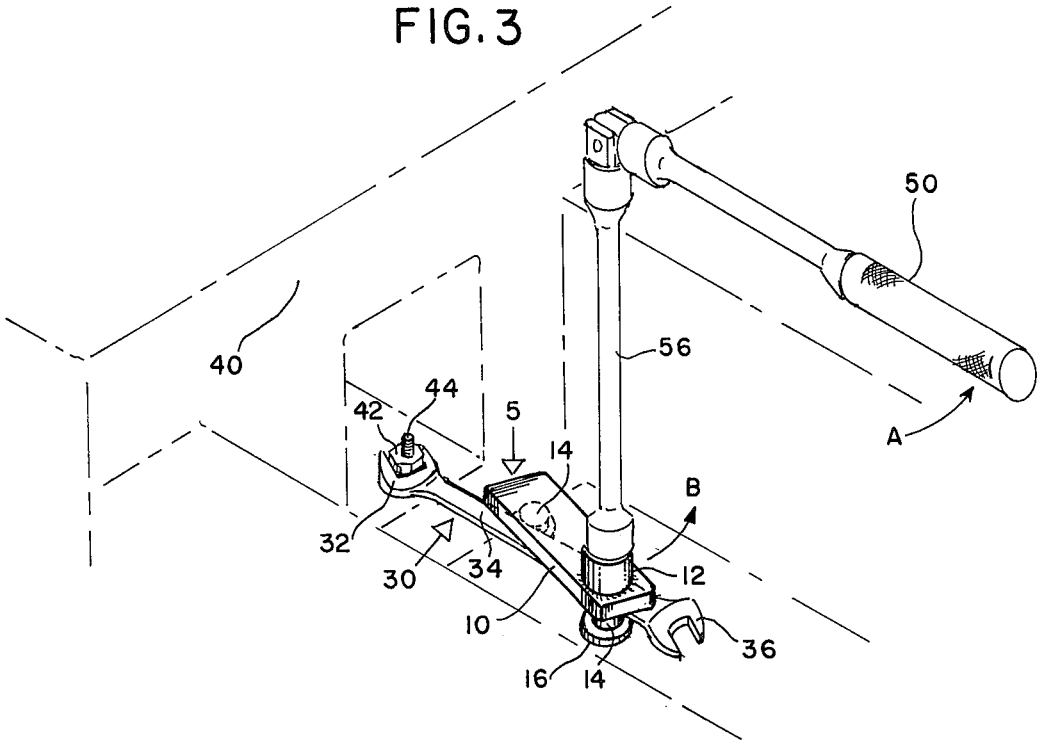
FIG. 3 is a perspective view of the flat wrench extender tool of FIG. 1 in use to loosen a nut in a restricted space of a machine shown in broken-line view, FIG. 4–A is a side view of my extender tool placed over a flat wrench handle seen in cross section, FIG. 4–B is the extender tool of FIG. 4-A being driven by an extension bar showing locking action of the tool.

The torque on wrench 30 produced by the force on drive handle 50 in FIG. 3 causes nut 42 to be loosened. When flat wrench 30 is thus turned to its limit, tool 5 is removed, wrench 30 turned over, tool 5 installed, and nut 42 loosened further in a conventional off-set wrench operation.

To tighten nut 42 in the example of FIG. 3, my extender tool is placed over handle 34 with posts 14 on opposite sides of handle 34 from the illustration. When torque is applied as previously described but in the opposite direction, posts 14 contact the opposite edge of handle 34 thereby causing nut 42 to be tightened.

It is to be understood that extension bar 56 and flex handle 50 are not to be considered to be part of my invention. As will be obvious to one skilled in the art, a variety of conventional socket drive devices and accessories may be advantageously used in conjunction with my novel flat wrench extender tool.

As previously discussed, socket drive fitting 12 may be a standard square drive 18 as shown in FIG. 1. It is obvious that an 8-point socket 19 as shown in FIG. 5 can be used in fitting 12. This design, formed by two square drives displaced by 45°, provides additional flexibility in selecting the desired angle of the drive handle with respect to the flat wrench handle.

DESCRIPTION OF AN ALTERNATIVE EMBODIMENT

In many applications of flat wrenches, the user may have sufficient space but the length of the wrench may be too short and the user unable to exert sufficient torque. My extender tool is useful in such applications to provide additional leverage to the flat wrench. A socket drive handle, such as the flexhandle 50 of FIG. 3, can be connected directly to socket fitting 12 without the use of an extension bar 56. Thus, additional leverage can be applied to the flat wrench with the handle 50 being an essentially planar extension rather than the angular extension as previously described. However, an even more convenient leverage extender is provided by an alternative embodiment of my extender tool shown in FIG. 6.

Leverage extender tool 60 consists of a flat metal bar having a dog-leg shape with a short head end 63 and a long handle end 62 having an angle of approximately 150 degrees between the short end and long end. Two cylindrical posts 64 are mounted on one face of short end 63 in a similar fashion to posts 14 of the preferred embodiment. Concentric circular heads 66 are attached to posts 64. Long end 62 may be knurled to act as a handle as shown. The size of tool 60 may be selected for the range of flat wrenches to be extended. A typical set of dimensions for use with medium size wrenches is as follows:

Short end 63 — 4 inches.

Long end 62 — 11 inches.

Posts 64 — $\frac{3}{4}$ inches in diameter by 5/16 inches high.

Head 66 — $\frac{1}{2}$inches in diameter by 3/16 inches thick.

Spacing of post centers — $2\frac{3}{4}$ inches.

Leverage extender tool 60 may be coupled to a flat wrench with posts 64 projecting either upward or downward. As illustrated in FIG. 7, tool handle 62 is grasped in the hand and the flat wrench handle 72 of wrench 70 is engaged by posts 64. Force exerted in direction of the arrow causes torque to be generated on wrench 70 thereby tending to tighten bolt 80. With posts 64 projecting into the plane of the paper as shown in FIG. 7, extender tool 60 forms an angular extension with an angle of about 45 degrees. By inverting tool 60 such that the posts 64 project out of the plane of the paper, as indicated by the dashed lines, the tool 60 forms an essentially straight extension of flat wrench 70. This flexibility, coupled with angle-jawed flat wrenches, allows movement of the flat wrench even with restricted lateral space.

As may now be seen, I have provided simple, low-cost, flat wrench extender tools that permit the mechanic to greatly extend the usefulness of his flat wrenches, and to make use of a number of his socket wrench drive devices to assist in use of flat wrenches in locations otherwise not possible. Although I have described certain specific embodiments, it will be obvious to those skilled in the art that various modifications in design and materials can be made without departing from the scope or spirit of my invention.

I claim

1. A tool for operatively turning a flat wrench in otherwise inaccessible regions comprising:

a short bar having post-like projections disposed at each end of one side thereof, said projections being essentially in parallel, spaced relationship to each other, each of said projections consisting of a body portion and an enlarged head portion, said head portions also being spaced from each other; and coupling means on the opposite side of said bar for coupling said bar to a socket wrench driving device;

whereby said bar is arranged to allow coupling to the handle of the flat wrench by engaging the handle with said projections and applying torque to said bar via said coupling means so as to cause said head portions to hook over the handle thereby effectively preventing said tool from becoming disengaged from the wrench handle as long as such torque is maintained.

2. The tool as defined in claim 1 in which:

said body portion is a right cylinder; and said head portion is circular and concentric with said cylinder.

3. A tool as defined in Claim 1 in which said coupling means is a socket drive fitting having a recess, said recess is of square shape thereby adapting said recess to engage a square socket drive device.

* * * * *